US005164116A

United States Patent [19]

Berkhof et al.

[11] Patent Number: 5,164,116

[45] Date of Patent: Nov. 17, 1992

[54] DEMULSIFIERS FOR BREAKING PETROLEUM EMULSIONS

[75] Inventors: Rudi Berkhof, KC Delden; Herman Kwekkeboom, Di Losser, both of Netherlands; Dieter Balzer; Norbert Ripke, both of Haltern, Fed. Rep. of Germany

[73] Assignee: Huels Aktiengesellschaft, Marl, Fed. Rep. of Germany

[21] Appl. No.: 716,107

[22] Filed: Jun. 17, 1991

[30] Foreign Application Priority Data

Jul. 27, 1990 [DE] Fed. Rep. of Germany ..... 4023834

[51] Int. Cl.[5] ..... B01D 17/04

[52] U.S. Cl. ..... 252/331; 252/8.554; 252/325; 252/358

[58] Field of Search ..... 252/325, 358, 8.554, 252/331, 328

[56] References Cited

U.S. PATENT DOCUMENTS

| | | | |
|---|---|---|---|
| 3,640,998 | 2/1972 | Mansfield et al. | 260/210 R |
| 4,431,565 | 2/1984 | Billenstein et al. . | |
| 4,537,701 | 8/1985 | Oppenlaender et al. | 252/344 |
| 4,551,239 | 11/1985 | Merchant et al. | 208/188 |
| 4,834,903 | 5/1989 | Roth et al. | 252/174.1 |
| 4,968,449 | 11/1990 | Stephenson | 252/358 |
| 4,978,459 | 12/1990 | Bock et al. | 210/749 |
| 4,985,154 | 1/1991 | Balzer et al. | 252/8.554 |
| 5,039,450 | 8/1991 | Kupter et al. | 252/331 |

FOREIGN PATENT DOCUMENTS 0333135 9/1989 European Pat. Off. .

*Primary Examiner*—Richard D. Lovering
*Assistant Examiner*—N. Bhat
*Attorney, Agent, or Firm*—Oblon, Spivak, McClelland, Maier & Neustadt

[57] ABSTRACT

Demulsifiers which contain compounds of formula I $$R—O—Z_n—O—(AO)_xH \quad (I)$$

wherein R is a linear or branched, saturated or unsaturated $C_{1-18}$ alkyl radical, $Z_n$ is an oligoglycosyl radical with n=1 to 5 hexose or pentose units or mixtures thereof, AO is an ethylene oxide, propylene oxide or butylene oxide radical or mixtures thereof and x is 1 to 100, are useful for breaking water-in-oil petroleum emulsions. Such demulsifiers have a low specificity and are biodegradable.

9 Claims, 1 Drawing Sheet

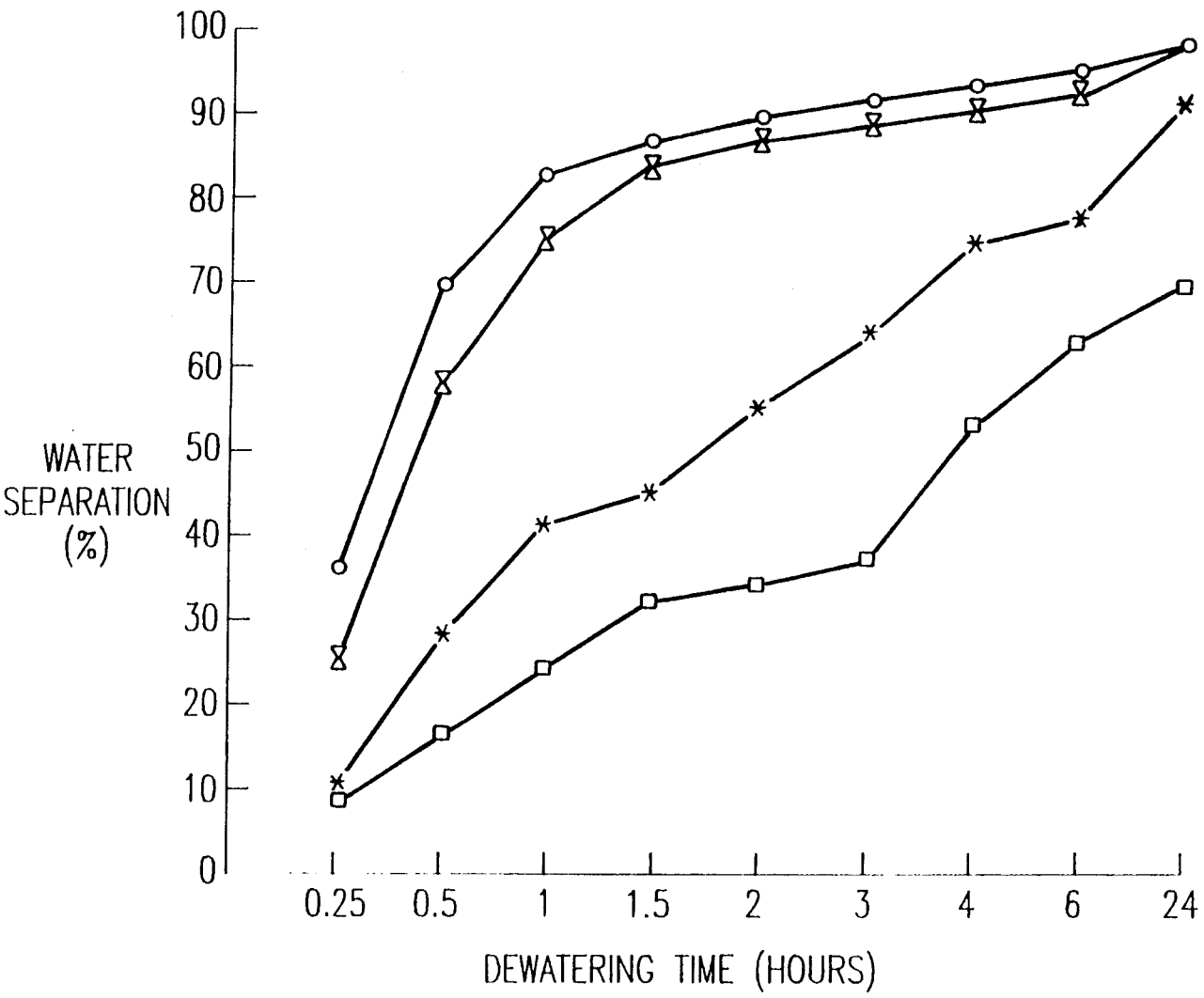
WATER SEPARATION (%)
100
90
80
70
60
50
40
30
20
10
0
0.25
0.5
1
1.5
2
3
4
6
24
DEWATERING TIME (HOURS)

DEMULSIFIERS FOR BREAKING PETROLEUM EMULSIONS

BACKGROUND OF THE INVENTION

1. Field of the Invention

The present invention relates to demulsifiers, for breaking water-in-oil emulsions, which contain alkoxylated alkyl polyglycosides and a method of breaking water-in-oil emulsions using such demulsifiers.

2. Discussion of the Background

The extraction of petroleum from underground reservoirs often results in water-in-oil emulsions which are usually very stable. The active emulsifiers are surface-active constituents within the petroleum, which are particularly concentrated in the petroleum resins and asphaltenes. Since the petroleum emulsions always have a much higher viscosity than that of the oil, transport thereof would mean a correspondingly higher pumping power. It is therefore necessary to break them as a step in the petroleum preparation process before transport. In addition, the disperse phase consists of salt water which usually has a high chloride content which would lead to considerable corrosion problems in refinery processing. The water must therefore be removed as substantially as possible. This is usually carried out by adding small amounts of demulsifiers (emulsion breakers) in the presence of heat. Good demulsifiers lead to as near quantitative oil/water separation as possible with, as far as possible, low use concentrations, low temperatures and short action time. The composition of petroleum varies widely throughout the world, and this also applies to the emulsifiers of the petroleum emulsions. Accordingly, the structures of the demulsifiers also have to be optimized for each petroleum emulsion.

Frequently used at present is demulsification using products of the reaction of alkylene oxides with alkylphenol/formaldehyde resins such as described, for example, in DE-A 20 13 820 and 31 42 955 and U.S. Pat. No. 2,560,333. Another important group of demulsifiers are ethylene oxide/propylene oxide block copolymers as described, for example, in DE-A 10 18 179 and 15 45 250. Another class of petroleum emulsion breakers consists of alkoxylated polyamines (DE-A 22 27 546 and EP-A 147 743). Finally, emulsifiers based on alkoxylated diisocyanates (DE-A 20 59 707) and bisglycidyl ethers (EP-A 55 434) are also described.

The disadvantage of the above-described demulsifiers is their extremely high specificity. That is to say a given structure or composition of demulsifier is suitable only for one reservoir, and in some cases even for only one sector. Other disadvantages, which are now very significant, are ecological in nature. Thus, the biodegradability of the above-described demulsifiers is usually completely inadequate and their aquatoxicity is considerable. The latter property is of great importance particularly in off-shore fields.

Thus, there remains a need for demulsifiers for breaking petroleum emulsions which can be employed under various reservoir conditions and, moreover, have, in particular, a high biodegradability and a low toxicity.

SUMMARY OF THE INVENTION

Accordingly, one object of this invention is to provide novel demulsifiers for breaking petroleum emulsions.

It is another object of the present invention to provide novel demulsifiers, for breaking petroleum emulsions, which may be used under a variety of reservoir conditions.

It is another object of the present invention to provide novel demulsifiers, for breaking petroleum emulsions, which have a high biodegradability.

It is another object of the present invention to provide demulsifiers, for breaking petroleum emulsions, which have a low toxicity.

It is another object of the present invention to provide a method for breaking petroleum emulsions utilizing such demulsifiers.

These and other objects, which will become apparent during the following detailed description, have been achieved according to the present invention by demulsifiers which comprise alkoxylated alkyl polyglycosides of the formula I $$R—O—Z_n—O—(AO)_xH \qquad I$$

where R denotes a linear or branched, saturated or unsaturated alkyl radical with 8–18 C atoms, $Z_n$ denotes an oligoglycosyl radical with n=1 to 5 hexose or pentose units or mixtures thereof, AO denotes ethylene oxide, propylene oxide or butylene oxide or mixtures thereof and x denotes 1 to 100.

BRIEF DESCRIPTION OF THE DRAWINGS

A more complete appreciation of the invention and many of the attendant advantages thereof will be readily obtained as the same become better understood by reference to the following detailed description when considered in connection with the accompanying drawings, wherein:

FIG. 1 illustrates the breaking of the W/O emulsion from a west Netherlands reservoir system (water content 45%) with a 3:1 mixture of alkoxylated alkyl polyglycoside and alkoxylated polyalkylene-polyamine (B); O, demulsifier of Example 2; X, demulsifier of Example 8; *, demulsifier B; □, demulsifier C.

DETAILED DESCRIPTION OF THE PREFERRED EMBODIMENTS

Hence the invention relates to demulsifiers for breaking water-in-oil petroleum emulsions, which are characterized in that they contain alkoxylated alkyl polyglycosides of the formula I $$R—O—Z_n—O—(AO)_xH \qquad I$$

where R denotes a linear or branched, saturated or unsaturated alkyl radical with 8–18 C atoms, $Z_n$ denotes an oligoglycosyl radical with n=1 to 5 hexose or pentose units or mixtures thereof, AO denotes an ethylene oxide, propylene oxide or butylene oxide radical or mixtures thereof and x denotes 1 to 100. Thus, each Z may be a pentose or hexose unit, and the present alkoxylated alkyl polyglycosides include those which contain both hexose and pentose units in the same molecule. Further, although in any given molecule n will be an integer, the present alkoxylated alkyl polyglycosides include mixtures in which n represents an average value which includes noninteger values.

The class of alkoxylated alkyl polyglycoside compounds and the use thereof in detergents has been known for a long time (U.S. Pat. Nos. 3,640,998 and 4,834,903). On the other hand, their use as demulsifiers for oil-external petroleum emulsions is unknown.

It has now been found, surprisingly, that the demulsifiers according to the invention have a considerably lower specificity (wider applicability) than known petroleum emulsifiers. Likewise a great advantage compared with known demulsifiers systems is the ecological profile of the alkoxylated alkyl polyglycosides; this applies both to the biodegradability and to the toxicity for aquatic organisms.

Alkyl Polyglycosides

The alkoxylated alkyl polyglycosides to be employed according to the present invention correspond to the general formula I $$R—O—Z_n—O—(AO)_xH \quad \text{I}$$

in which R represents a linear or branched, saturated or unsaturated alkyl radical with 8 to 18, preferably 9 to 16, carbon atoms, $Z_n$ represents an oligoglycoside residue with n=1.0 to 5, preferably 1.1 to 3.0, hexose or pentose units or mixtures thereof, AO represents an ethylene oxide, propylene oxide or 1,2-butylene oxide residue or mixtures thereof, preference being given to blocks of these residues, and x represents the number 1 to 100, preferably 10 to 75. A particularly advantageous structure is one in which the alkyl polyglycoside is initially propoxylated and then ethoxylated.

The alkoxylated alkyl polyglycosides to be employed according to the present invention were prepared approximately in analogy to U.S. Pat. No. 4,834,903 by alkoxylation at elevated temperature and elevated pressure from an alkyl polyglycoside and an alkene oxide in the presence of alkaline catalysts such as, for example, KOH. The preferred reaction conditions are temperatures of 120°-180° C. and pressures of 2 to 7 bar.

The basic alkyl polyglycosides can be prepared by known processes based on replenishable raw materials. For example, dextrose is reacted in the presence of an acid catalyst with n-butanol to give butyl polyglycoside mixtures which undergo transglycosidation with long-chain alcohols, likewise in the presence of an acid catalyst, to give the required alkyl polyglycoside mixtures. Alternatively, dextrose is reacted directly with the required long-chain alcohol.

The structure of the products can be varied within certain limits. The alkyl radical R is fixed by the choice of the long-chain alcohol. For economic reasons, the surfactant alcohols which have 10 to 18 C atoms and are obtainable on an industrial scale, especially natural fatty alcohols from the hydrogenation of fatty acids or fatty acid derivatives, are favored. Ziegler alcohols or oxo alcohols can also be used.

The polyglycosyl radical $Z_n$ is fixed on the one hand by the choice of the carbohydrate, and on the other hand by the adjustment of the average degree of polymerization, n, for example in accordance with DE-A 19 43 689. It is known to be possible in principle to employ polysaccharides, for example starch, maltodextrins, dextrose, galactose, mannose, xylose, etc.

The carbohydrates starch, maltodextrins and, especially dextrose, which are available on an industrial scale, are preferred. Because the economically interesting alkyl polyglycoside syntheses do not take place regio- and stereoselectively, the alkyl polyglycosides are always mixtures of oligomers which, in turn, represent mixtures of various isomeric forms. They are present side by side with α- and β-glycosidic linkages in the pyranose and furanose form. The points of linkage between two saccharide residues can also be different.

The degree of glycosidation is expediently determined by $^1H$ NMR.

Preferred basic alkyl polyglycosides are alkyl polyglycosides.

The alkyl polyglycosides may also contain, owing to the synthesis, additional substances such as residual alcohols, monosaccharides, oligosaccharides and oligoalkyl polyglycosides.

The alkoxylated alkyl polyglycosides according to the present invention are preferably employed as solutions—also for reasons of easier metering—for breaking the water-in-oil emulsions. The solvents which can be used are water and organic solvents such as, for example, toluene, xylene, $C_{1-4}$ alcohols, THF or light naphtha. Such solutions have active ingredient concentrations of 0.1 to 50 wt. %, preferably at least 10 wt. %, most preferably at least 20 wt. %, based on the weight of the solution. They are preferably added at the extraction wells, and breaking then takes place during transport through the pipe and can, where appropriate, be completed with the assistance of an electric field. The amount of demulsifier to be employed for breaking the crude oil emulsion is 1 to 5,000 ppm, preferably 1 to 1,000 ppm, based on the mass of the crude oil emulsion; the temperature is advantageously 30°-90° C., preferably 40°-80° C.

Although the present method may be carried out by contacting the present demulsifiers with any water-in-oil petroleum emulsion, the water-in-oil petroleum emulsion will usually contain 0.1 to <50 wt. % water.

ADDITIVES

Other known breaking components can be added to the demulsifier solutions, and the amounts of these additives are from 10 to 90 wt. %, preferably 25 to 75 wt. %, based on the weight of the solution. Examples of suitable additives are compounds of formulae II to V, the latter being added singly or in admixture:

Formula II:

$$HO—(C_2H_4O)_a(C_3H_6O)_b(C_2H_4O)_cH$$

where b ≧17, preferably ≧20, and the ethylene oxide content is between 30 and 80 wt. %, preferably 40 to 70 wt. %, and which are optionally reacted with difunctional crosslinkers, such as diisocyanates and/or dicarboxylic acids.

Formula III:

$$[HO—(C_2H_4O)_d(C_3H_6O)_e]_k—R'—[(C_3H_6O)_f(C_2H_4O)_gH]_l$$

in which R' is a polyhydric alcohol radical, derived from, e.g., a $C_{1-4}$ alkyl polyol (such as ethylene glycol, butanediol, and glycerol), a hexose, a pentose, bisphenol A, etc.; d+g is 10-80, preferably 20-70; the propylene oxide content is between 20 and 90 wt %, preferably 40 to 70 wt. %; k is 1 or 2; and l is 1 or 2, and which are optionally reacted with difunctional crosslinkers, such as diisocyanates and/or dicarboxylic acids.

Formula IV:

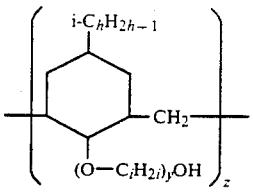

in which h is 6 to 14, preferably 8 to 12; i is 2 to 3; y is 5 to 40, preferably 10 to 30; and z is 3 to 25, preferably 5 to 20, which are optionally reacted with difunctional crosslinkers, such as diisocyanates and/or dicarboxylic acids.

Formula V:

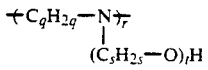

in which q is 2 and/or 3; r is 50 to 1,000, preferably 100 to 900; s is 2 and/or 3; t is 50 to 200, preferably 75 to 175; and which are optionally reacted with difunctional crosslinkers, such as diisocyanates and/or dicarboxylic acids. Thus, the compounds of Formula V include those in which in each repeating unit $-(C_qH_{2q}-N)-_r$, q may be, independently 2 or 3. Similarly, in each repeating unit $-(C_sH_{2s}-O)-_t$, s may be, independently 2 or 3.

Suitable difunctinal crosslinkers for preparing the crosslinked versions of the compounds of Formulae II to V include: diisocyanates, such as hexamethylene diisocyanate-1,6 (HDI), 2-methyl-pentamethylene-diisocyanate-1,5, 2,2,4(2,4,4)-trimethyl-hexamethylene-diisocyanate-1,6 (TMDI), isophorone diisocyanate (IPDI), methylene-bis-(4-cyclohexyl isocyanate), tetramethyl-xylylene-diisocyanate, and 1,4-bis-(isocyanatomethyl)-cyclohexane, and dicarboxylic acids, such as succinic acid, adipic acid, sebacic acid, phthalic acid, and isophthalic acid.

Other features of the invention will become apparent in the course of the following descriptions of exemplary embodiments which are given for illustration of the invention and are not intended to be limiting thereof.

EXAMPLES

EXAMPLE 1

In an alkoxylation autoclave, 300 g of $C_{12}$–$C_{14}$-alkyl polyglycoside with a degree of glycosidation (D.P.) of 1.2 (monoglycoside content 43%, residual fatty alcohol 0.8%) were reacted with 1,200 g of propylene oxide at 155° C. with the addition of about 1 g of potassium hydroxide until absorption was complete. The final product contains about 75 wt. % propylene oxide and 25 wt. % alkyl polyglycoside.

EXAMPLES 2–7

$C_{12}$–$C_{14}$-alkyl polyglycoside (D.P. of 1.2) was propoxylated under conditions similar to those in Example 1. The products were then ethoxylated, to give the products shown in Table 1.

TABLE 1

| Example | Demulsifiers APG[a] (%) | PO[b] (%) | EO[c] (%) |
|---|---|---|---|
| 2 | 6.3 | 75 | 19 |
| 3 | 5.4 | 66 | 29 |
| 4 | 4.6 | 56 | 39 |
| 5 | 3.9 | 47 | 49 |
| 6 | 3.1 | 37 | 60 |
| 7 | 4.3 | 76 | 20 |

[a]Content of alkyl polyglycoside in product.
[b]Content of propylene oxide in product.
[c]Content of ethylene oxide in product.

EXAMPLE 8

$C_{10}$–$C_{12}$-Alkyl polyglycoside (D.P. 1.1, monoglycoside content 50%, residual fatty alcohol 0.5%) was initially propoxylated and then ethoxylated under conditions similar to those in Examples 2 to 7. The product contains 8% alkyl polyglycoside (APG), 60% propylene oxide (PO) and 32% ethylene oxide (EO).

EXAMPLE 9

Demulsifier Action

The action of the demulsifiers was tested on various petroleum emulsions and compared with currently conventional breakers using the so-called bottle test (see "Treating Oil Field Emulsions", Ed. American Petrol. Instit., Dallas, Tex., 1974). The comparison breakers were a propoxylated, ethoxylated glycerol block copolymer (A); a mixture of an A-analogous block copolymer with an alkoxylated polyamine corresponding to DE 22 27 546 (B); and a mixture of an alkylated phenol/formaldehyde resin with a product of the reaction of an A-analogous compound with a dicarboxylic acid (C). The compounds were used in toluene solution with an active ingredient concentration of 30 ppm at 60° C. The great efficiency of the demulsifiers according to the present invention as compared with the conventional products is shown on various petroleum emulsions in Tables 2 and 3 and in FIG. 1.

TABLE 2

| Demulsifier | Breakage (%) |
|---|---|
| A | 62 |
| 1 | 60 |
| 2 | 75 |
| 3 | 88 |
| 4 | 94 |
| 5 | 99 |
| 6 | 75 |

Breaking of the emulsion from an east Netherlands reservoir, water content 26%, breaking time 2 hour, for demulsifier no. see details in Examples 1–9.

TABLE 3

| Demulsifier | Breakage (%) |
|---|---|
| B | 73 |
| 1 | 68 |
| 2 | 78 |
| 3 | 85 |
| 4 | 92 |
| 5 | 100 |

Breaking of the emulsion from an east Netherlands off-shore field, water content 31%, breaking time 2 hour, for demulsifier no. see details in Examples 1–9.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A method for breaking a water-in-oil petroleum emulsion, comprising contacting a water-in-oil petroleum emulsion with a demulsifier comprising an alkoxylated alkyl polyglycoside of formula I $$R-O-Z_n-O-(AO)_xH \quad (I)$$

wherein R is a linear or branched, saturated or unsaturated $C_{1-18}$ alkyl radical; $Z_n$ is an oligoglycosyl radical with n=1 to 5 hexose or pentose units or mixtures thereof; AO is ethylene oxide, propylene oxide or butylene oxide or mixtures thereof; and x is 1 to 100.

2. The method of claim 1, wherein R is a linear, saturated $C_{9-16}$ alkyl radical; $Z_n$ is an oligoglycosyl radical with n=1.1 to 3; AO is ethylene oxide, propylene oxide, 1,2-butylene oxide, or mixtures thereof; and x is 10 to 75.

3. The method of claim 1, wherein $(AO)_x$ is a block polymer of ethylene oxide, propylene oxide, or 1,2-butylene oxide or a block copolymer of two or more members selected from the group consisting of ethylene oxide, propylene oxide, and 1,2-butylene oxide.

4. The method of claim 1, wherein said demulsifier further comprises at least one agent selected from the group consisting of:

(a) a compound of formula II:

$$HO-(C_2H_4O)_a(C_3H_6O)_b(C_2H_4O)_cH$$

wherein $b \geqq 17$ and the ethylene oxide content is between 30 and 80 wt. %, and derivatives thereof prepared by reacting a compound of formula (II) with a difunctional crosslinker;

(b) a compound of formula (III)

$$[HO-(C_2H_4O)_d(C_3H_6O)_e]_k-R'-[(C_3H_6O)_f(C_2H_4O)_gH]_l$$

wherein R' is a polyhydric alcohol radical; d+g is 10–80; the propylene oxide content is between 20 and 90 wt. %; k is 1 or 2; and l is 1 or 2, and derivatives thereof prepared by reacting a compound of formula (III) with a difunctional crosslinker;

(c) a compound of formula (IV)

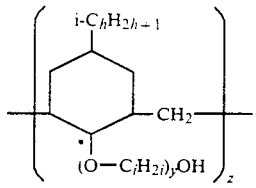

wherein h is 6 to 14; i is 2 to 3; y is 5 to 40; and z is 3 to 25, and derivatives thereof prepared by reacting a compound of formula (IV) with a difunctional crosslinker; and (d) a compound of formula (V)

$$\left[C_qH_{2q}-\underset{\substack{|\\(C_sH_{2s}-O)_tH}}{N}\right]_r$$

wherein q is 2 and/or 3; r is 50 to 5,000, s is 2 and/or 3; and t is 50 to 200, and derivatives thereof prepared by reacting a compound of formula V with a difunctional crosslinker.

5. The method of claim 1, wherein said alkoxylated alkyl polyglycoside is present in said demulsifier in an amount of at least 10 wt. %.

6. The method of claim 1, wherein said alkoxylated alkyl polyglycoside is present in said demulsifier in an amount of at least 20 wt. %.

7. The method of claim 1, wherein said demulsifier is in the form of a solution in which said alkoxylated alkyl polyglycoside is dissolved in a solvent selected from the group consisting of water, toluene, xylene, $C_{1-4}$ alcohols, THF, and light naphtha.

8. The method of claim 1, wherein said demulsifier is contacted with said emulsion in an amount sufficient to result in said emulsion being contacted with said alkoxylated alkyl polyglycoside in an amount of 1 to 1,000 ppm based on the weight of said emulsion.

9. The product produced by the method of claim 1.

* * * * *